US006394289B1

(12) United States Patent
Panchihak et al.

(10) Patent No.: US 6,394,289 B1
(45) Date of Patent: May 28, 2002

(54) VALET ROD

(75) Inventors: Luiz R. Panchihak, Tiburon; Donald J. Papa, San Rafael, both of CA (US)

(73) Assignee: California Closet Company, Inc., San Rafael, CA (US)

( * ) Notice: Subject to any disclaimer, the term of this patent is extended or adjusted under 35 U.S.C. 154(b) by 0 days.

(21) Appl. No.: 09/748,272

(22) Filed: Dec. 27, 2000

(51) Int. Cl.[7] ..... A47H 1/02
(52) U.S. Cl. ..... 211/105.1
(58) Field of Search ..... 211/105.1, 100, 211/123, 85.3, 111, 168, 171

(56) References Cited

U.S. PATENT DOCUMENTS

| | | | | |
|---|---|---|---|---|
| 1,219,476 | A | * | 3/1917 | Nelson |
| 1,391,495 | A | | 9/1921 | Parsons |
| 2,048,519 | A | * | 7/1936 | Rose |
| 2,224,247 | A | * | 12/1940 | Bentz |
| 2,582,812 | A | | 1/1952 | Wise |
| 3,137,393 | A | * | 6/1964 | Marcus |
| 3,452,954 | A | * | 7/1969 | Lucietto et al. |
| 4,360,109 | A | * | 11/1982 | Kurtz |
| 4,611,717 | A | | 9/1986 | Hutson |
| 4,767,013 | A | * | 8/1988 | Bertelli |
| 4,898,355 | A | | 2/1990 | Steinway |
| 4,928,833 | A | | 5/1990 | Huizenga |
| 5,337,905 | A | | 8/1994 | Gast |
| 5,538,146 | A | * | 7/1996 | Gast |
| 5,702,010 | A | * | 12/1997 | Liang |

* cited by examiner

*Primary Examiner*—Alvin Chin-Shue
*Assistant Examiner*—Sarah Purol
(74) *Attorney, Agent, or Firm*—Jacobson Holman, PLLC

(57) ABSTRACT

A hanger assembly or valet rod adapted for attachment to a vertically extending supporting surface, such as a side surface or front edge surface of a panel member of a modular closet organizer system or the like. In one embodiment, the hanger is rotatably carried at one end by a base plate preferably attached by a pair of spaced pegs in selected holes in a row of vertically extending spaced holes preformed in the panel side surface. Stop members are provided to support the rod in a generally horizontally extending operative position for carrying one or more articles, with the rod being movable to a generally vertically extending retracted position where it does not interfere with the use of the closet compartment. The stop members may be repositioned for use of the valet rod on an opposite side surface of the closet organizer panel. A second embodiment provides a pair of vertically spaced pivot members, each of which includes rotatable bushing members defining an arcuate through-opening for reception of one of a pair of arcuate arm elements connected to each other to form a generally V-shaped hanger arm. The hanger arm elements slide in the through-openings and the pivot members rotate about their axes to permit the hanger arm to move between its operative and retracted positions. A third embodiment of valet rod comprises a base member to be fixed by screws or the like to the front edge surface of a closet organizer panel, with a hanger arm pivotally connected at one end of the base member and a stop element supporting the hanger arm in a generally horizontally extending operative position, permitting the hanger arm to be rotated upwardly to be juxtaposed to the base member in a retracted position.

42 Claims, 7 Drawing Sheets

VALET ROD

BACKGROUND OF THE INVENTION

1. Field of the Invention

This invention relates to a hanger assembly, sometimes called a valet rod, adapted to be attached to a vertically extending supporting surface of a storage compartment, such as the side wall or front edge of a panel in a modular closet organizer system, to provide a temporary station for hanging clothes or other objects while the articles are waiting to be sorted and distributed throughout the closet or in a suitcase for travel, or as an overnight station for clothes to be worn the next day, wherein the rod can be moved to an out-of-the-way position when not in use.

2. Description of the Prior Art

One form of hanger assembly is seen in U.S. Pat. No. 5,337,905 issued Aug. 16, 1994 to Arnold E. Gast. The Gast valet rod utilizes a rather cumbersome mounting sleeve which, in cooperation with the surface of a modular closet organizer panel, defines a guide shaft for sliding reception of an elongated hanger rod or arm, an arrangement that provides an inconsistent guiding surface.

Moreover, the Gast hanger assembly is designed for use in standard knock-down cabinetry, generally referred to as "System 32 mm" wherein the vertical panels include inner and outer vertically extending rows of holes, juxtaposed to their front and rear edges, generally spaced from each other by a distance of 32 mm. The holes are provided to frictionally receive protrusions or pegs of L-shaped shelf supports in a well known manner. The Gast mounting sleeve must be secured in a pair of holes in the front row and an aligned pair of holes in the rear row, making, the sleeve and hanger arm assembly particularly hard to retrofit into an existing storage compartment.

Finally, the need for a mounting sleeve which is long enough to receive substantially the entire length of the hanger rod and wide enough to engage front and rear holes above and below the rod on the storage compartment panel, renders the assembly bulky and unattractive.

Other prior art valet rod systems tend to be difficult to assemble or use, particulary in association with modular closet organizer systems wherein the panels are provided with pre-existing patterns of holes. Such other systems also tend to be relatively expensive to manufacture and/or aesthetically unacceptable.

OBJECTS AND SUMMARY OF THE INVENTION

It is a primary object of the instant invention to provide several embodiments of valet rods designed to be readily attached to selected supporting surfaces of a modular closet organizer or the like, which are relatively simple and inexpensive to manufacture, assemble and use, efficient in operation, and attractive in appearance.

A further object of this invention is the provision of embodiments of a hanger assembly of the type described especially adapted for installation using only the front row of pre-existing holes defined in the panels of a modular closet organizer.

Another object of this invention is provide a hanger assembly embodiment which can be used on either the left- or right-hand vertically extending surface of panels of modular closet organizer systems with minimal need for modification.

Yet another object of this invention is the provision of a hanger assembly wherein the hanger arm is rotatably fixed at one end to a small base member attached to a modular closet organizer panel for pivotal movement of a hanger arm between an operative position wherein it is supported in a generally horizontally extending relationship to receive and carry one or more articles spaced from the storage compartment, and a retracted position wherein it is substantially totally withdrawn into the closet compartment, closely adjacent to the panel surface, to avoid significantly obstructing the use of the closet.

A still further object of this invention is the provision of a uniquely attractive and functionally effective valet rod embodiment wherein the hanger arm is formed by a pair of arcuate elements secured to each other at an apex at one end to form a generally V-shape, with a pair of pivot members secured in vertically spaced relationship in the forward row of holes of a modular closet organizer panel, each pivot element slidably receiving one leg of the V-shaped hanger arm while rotating about its central axis as the hanger arm is moved between its retracted and operative positions.

Yet another object of this invention is the provision of an embodiment of hanger assembly in which a hanger arm is adapted to be pivotally carried by a base attached to the front edge of a modular closet organizer panel or the like when the use of valet rods designed for mounting on one of the side surfaces of such panels is inconvenient.

Upon further study of the specification and the appended claims, additional objects and advantages of this invention will become apparent to those skilled in the art.

BRIEF DESCRIPTION OF THE DRAWINGS

The combination of elements, arrangement of parts and features of construction that lead to the inventive valet rods of the instant invention will be pointed out in more detail hereinafter with respect to the accompanying drawings wherein.

Like parts are designated by like reference characters throughout the several views of the drawings. Alternate positions of the same element are shown in dotted lines and designated by the same reference character followed by a prime (').

DETAILED DESCRIPTION OF THE PREFERRED EMBODIMENTS

Figure 1:
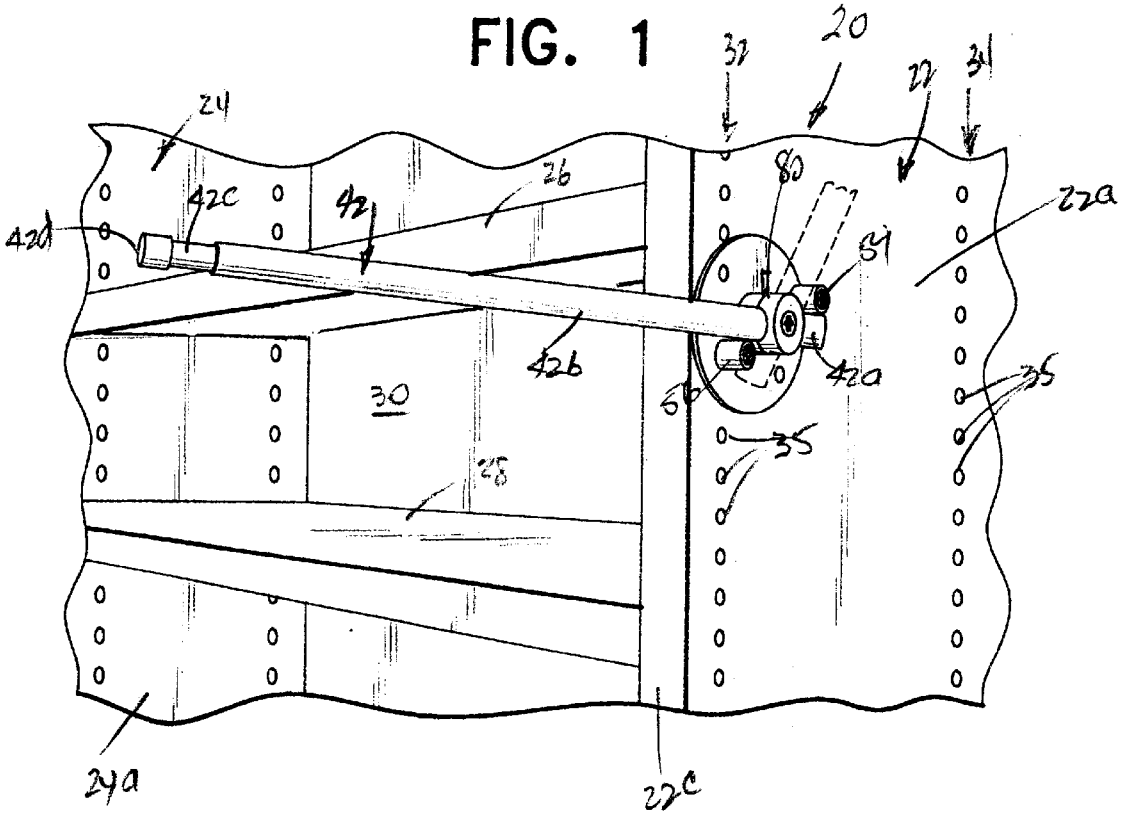
FIG. 1 is a fragmentary perspective view of a valet rod according to one embodiment of the instant inventive concepts carried by a panel of a modular closet organizer, with a portion of the valet rod in the retracted position shown in dotted lines.
Figure 6:
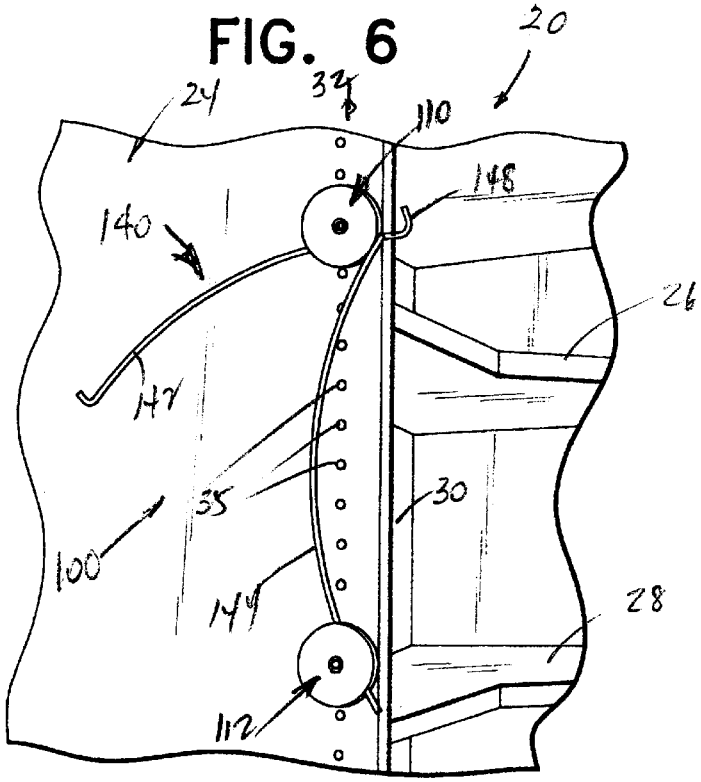
FIG. 6 is a fragmentary perspective view of a second embodiment of valet rod according the instant inventive concepts.

Referring now to the drawings in general, portions of a standardized, knock-down, modular closet organizer are identified generally by the reference numeral 20. The storage system 20 commonly employs a multiplicity of generally vertically extending sides or panels 22, 24, general horizontally extending shelves 26, 28 and a back 30.

The vertical panels in a standard System 32 mm closet system commonly include at least two vertically extending rows, 32, 34 of pre-drilled holes 35 spaced apart from each other by 32 mm. The holes 35 are commonly used to frictionally receive pegs of L-shaped shelf-supports (not shown) to permit the shelves 26, 28 to be spaced apart by any selected distance, and moved as desired.

Although the valet rods of the instant invention will function with any storage compartment, regardless of whether the components are "stick-built", modular or knock-down, made of any material including wood, plastic or even metal, pre-drilled with System 32 mm holes, holes of another pattern, or no holes at all, the followed detailed discussion of the preferred embodiments of this invention will be directed to use of the same in association with a System 32 mm, knock-down, wooden, modular closet organizer such as shown at 20.

Figure 2:
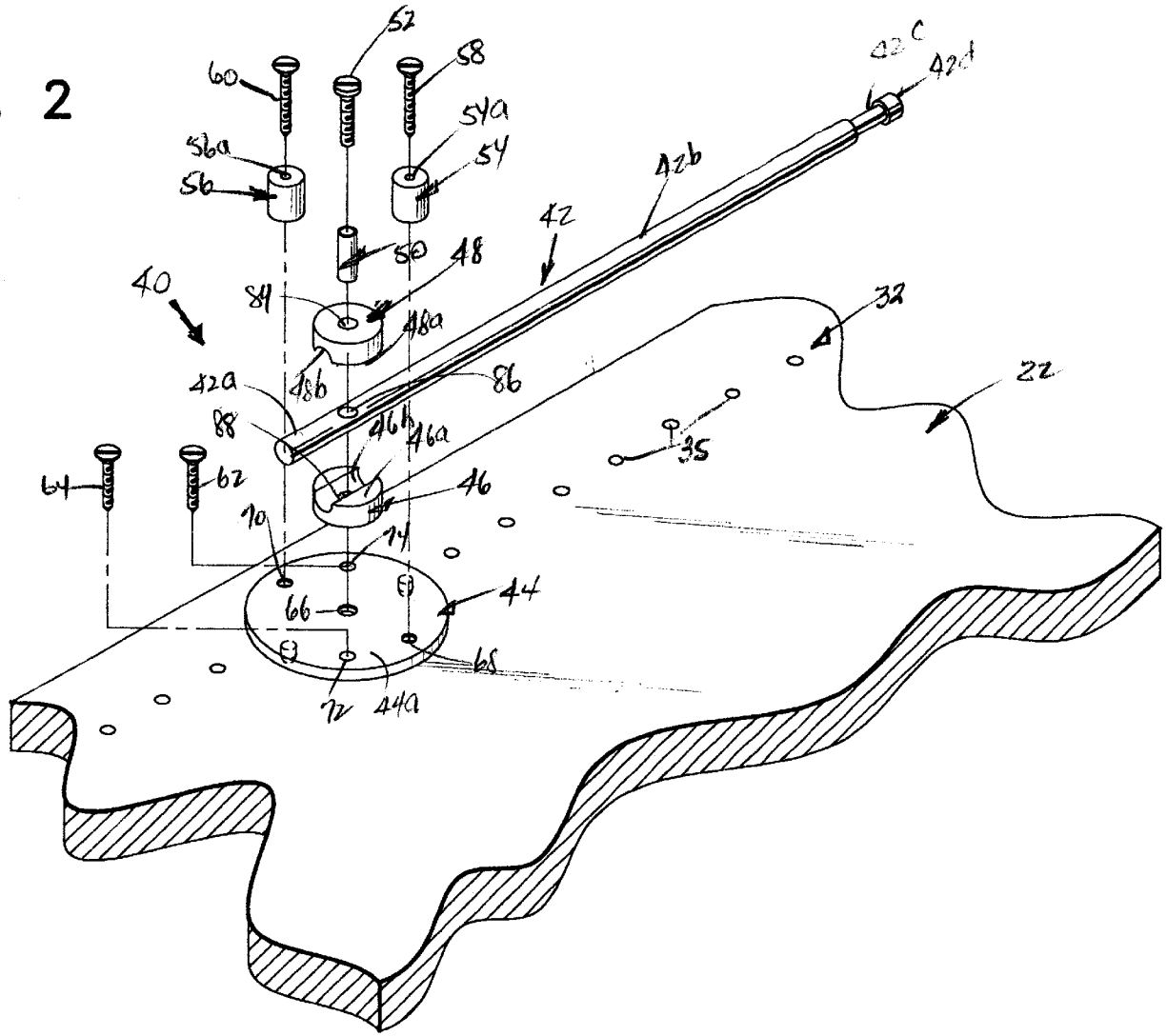
FIG. 2 is an exploded perspective view schematically illustrating the individual elements of the valet rod of FIG. 1.

Referring now to FIGS. 1–5, one preferred embodiment of a hanger assembly or valet rod of the instant invention is designated generally by the reference numeral 40 and, as seen best in FIG. 2 comprises an elongated hanger arm 42, a base member 44, a pair of bushing members 46, 48, an axle member 50, a threaded securing member or bolt 52 for the bushing assembly, a pair of stop members 54, 56, securing members 58, 60 for the stop members 54, 56, and auxiliary screws 62, 64 to attach the hanger assembly 40 to the storage compartment panel 22.

The base member 44 is preferably circular and formed of metal, having a front face 44*a* and rear face 44*b*. A central threaded opening 66 is provided to receive the bushing assembly securing member 52 and two pairs of diametrically opposed through-openings 68, 70 and 72, 74 are provided for selective attachment of the pair of stop members, 54, 56 with the securing members 58, 60 in a manner and for a purpose to be described in more detail hereinafter.

A pair of diametrically opposed peg members 76, 78 extend from the rear surface 44*b* of the base member 44 (see, particularly, FIG. 5) for frictional engagement in a selected pair of openings 35 in the panel 22. Although the spacing between the pegs 76, 78 may vary, for use with a System 32 mm closet organizer, the pegs 74, 76 are preferably spaced apart by 64 mm.

Bushing members 46, 48, in combination with the axle member 50 and the securing member 52, form a pivot member 80 having a rotation axis 78, for the hanger arm 42. As illustrated, the mating surfaces 46*a*, 48*a* of the bushing members 46, 48 define arcuate recesses 46*b*, 48*b*, together forming a transverse through-opening 82 which is complementary to the cross-sectional configuration of an intermediate portion of the hanger arm 42 captured therebetween when the pivot member 80 is fully assembled.

The axle member 50 is hollow and is rotatably received in aligned apertures 84 in the bushing member 48, 86 in the hanger arm 42, and 88 in the bushing member 46, with the securing element 52 passing through the axle member 50 and threadably engaged in the threaded opening 66 in the base member 44 to fix the hanger arm 42 to the base member 44 for rotation with the bushing members 46, 48 about the axis 78.

The intermediate portion of the hanger arm 42 captured by the bushing members 46, 48 is much closer to one end of the hanger arm 42 than the other to provide a minor portion 42*a* of the hanger arm 42 extending from one side of the through-opening 80 in the bushing members 46, 48, with a major portion 42*b* of the hanger arm 42 extending from the opposite side of the through-opening 80. A reduced portion 42*c* may be provided on the free end of the hanger arm 42 to preclude articles (not shown) carried by the hanging arm 42 from sliding off the free end 42*d*.

The stop members 54, 56, may be made of any material including metal, but preferably have a rubber or plastic covering, and each stop has a central through-opening 54*a*, 54*b*, for reception of one of the securing elements 58, 60. As described hereinafter, the stop members 54, 56 may be selectively secured to the assembly through one of the pairs of openings 68, 70 or 72, 74. The openings 68, 70 and 72, 74 may be threaded if the securing elements 58, 60 are threaded bolts as shown. Alternatively, the securing elements 58, 60 may simply be screws long enough to pass through a selected pair of openings 68, 70 or 72, 74 for engagement in the panel member 22.

Figure 3A:
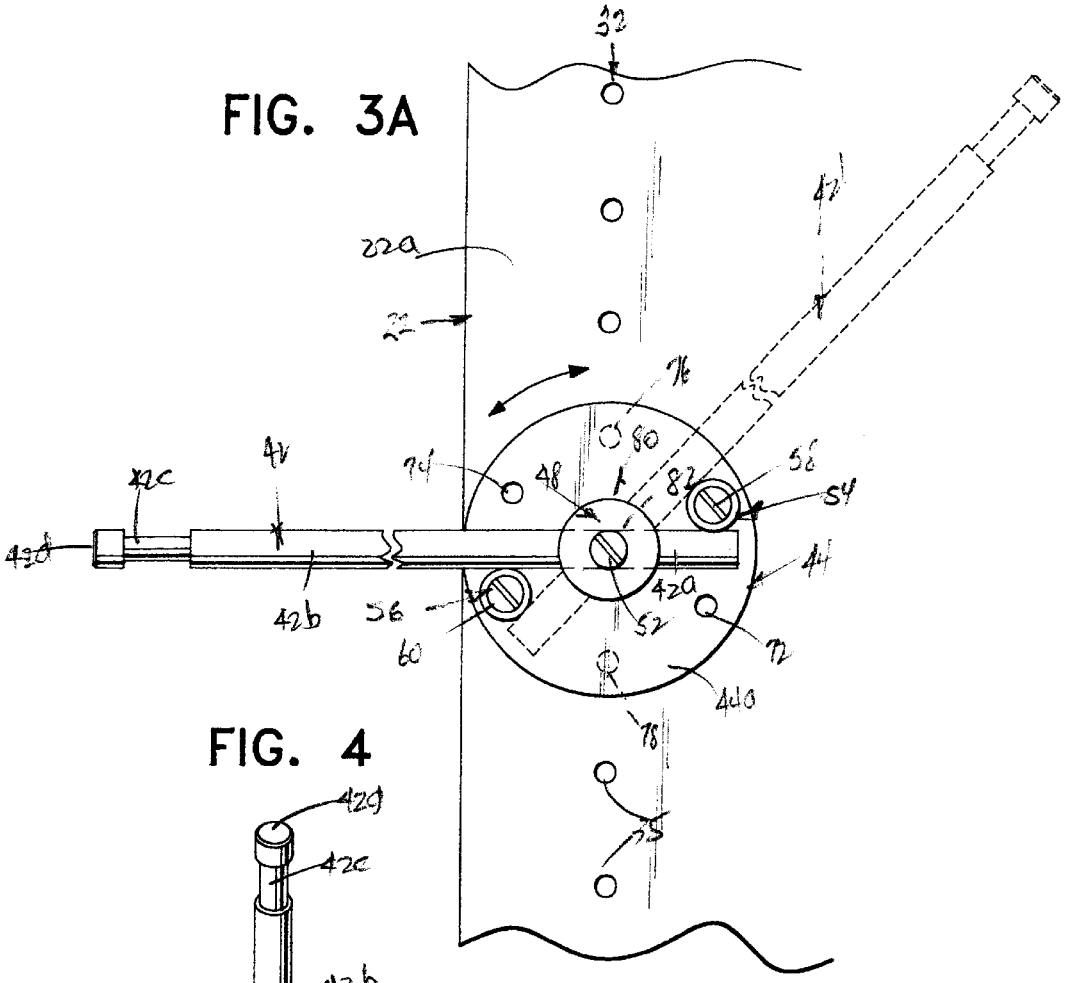
FIG. 3A is an elevational view of the valet rod of FIG. 1 showing the same as mounted on the one side of a modular closet organizer panel, with the hanger arm partially broken away and shown in solid lines in its operative position and in dotted lines in its retracted position.
Figure 4:
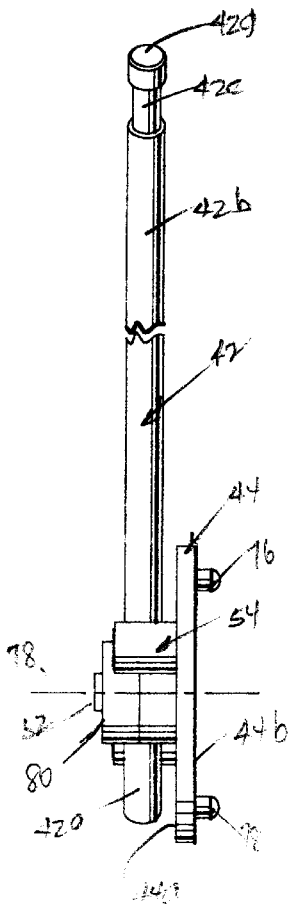
FIG. 4 is a side elevational view of the valet rod of FIG. 1, partially broken away for illustrative convenience.
Figure 5:
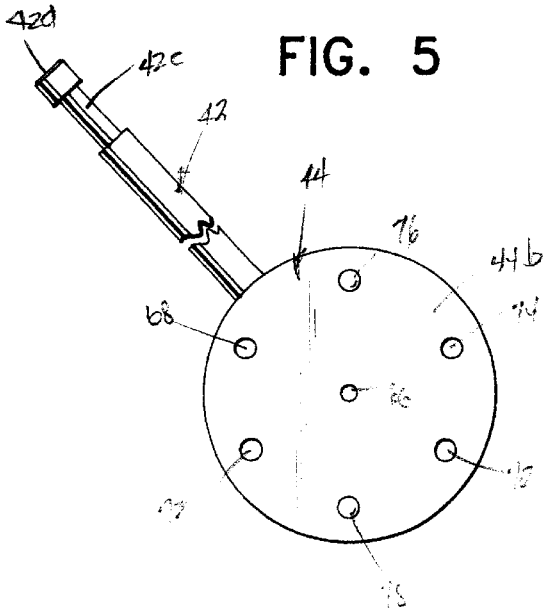
FIG. 5 is rear elevational view thereof.
Figure 3B:
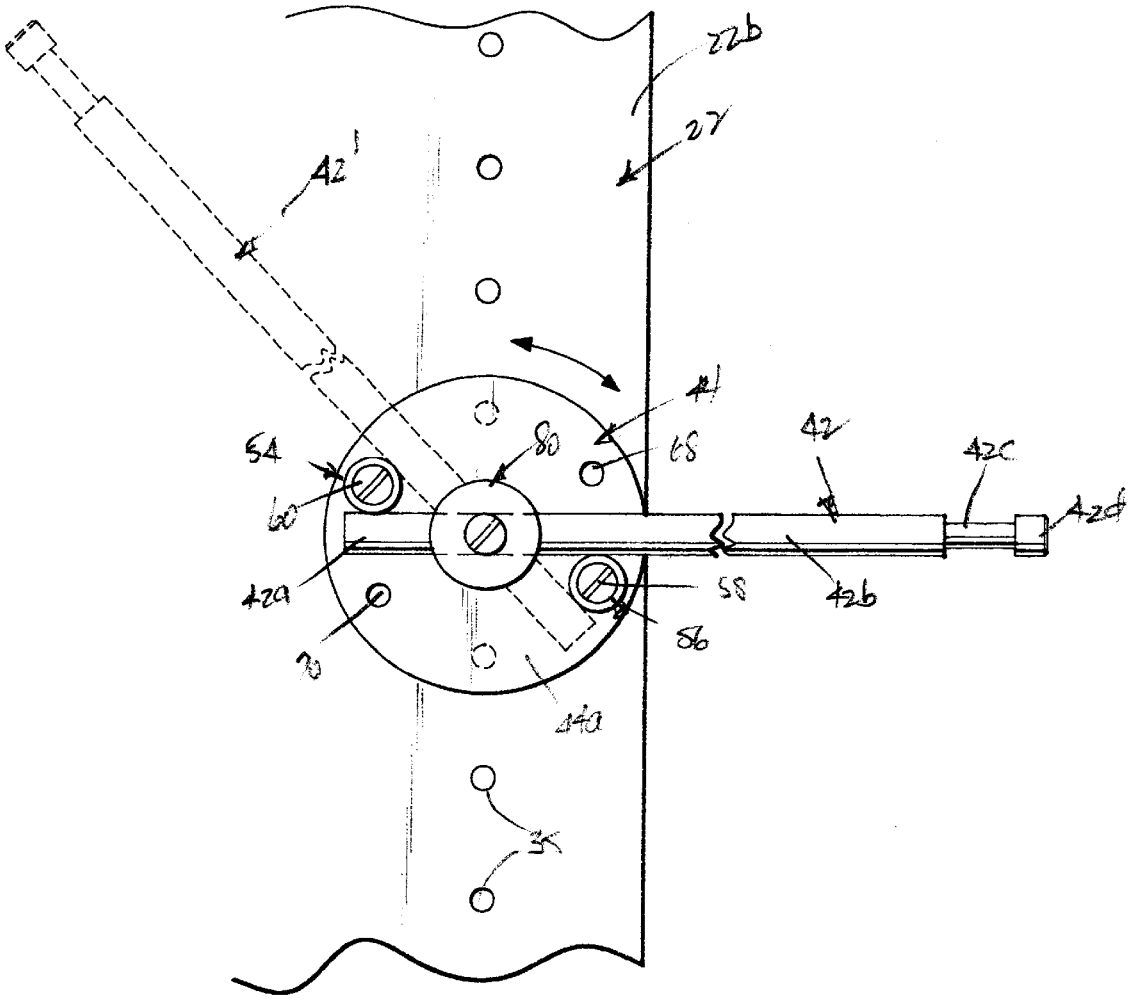
FIG. 3B is a view similar to FIG. 3A, but showing the valet rod modified for use on the opposite side of a panel of a modular closet organizer.

In FIG. 3A, the stop members 54, 56 are secured in the openings 68, 70 when the hanger assembly 40 is to be mounted on one surface 22*a* of the panel 22. When the hanger assembly 40 is to be mounted on the opposite surface 22*b* of the panel 22 as seen in FIG. 3B, the stop members 54, 56 may be repositioned in the other pair of opening 72, 74. In this fashion, the hanger assembly of the embodiment of FIGS. 1–5 may be readily modified for use on either the left- or right-side of a panel in a modular closet organizer or the like.

Regardless of which pair of openings 68, 70 or 72, 74 are used to carry the stop members 54, 56, the other pair of openings may receive the short screws 62, 64 or the like to more permanently affix hanger assembly 40 to a supporting surface. The use of the screws 62, 64 is optional since the pegs 76, 78 are dimensioned to be frictionally engaged in selected openings 35 pre-existing in the panels.

The pegs 76, 78 act as a pilot to properly locate the stop members 54, 56 so the hanger arm 40 is properly supported in both its operative and retracted positions. Obviously, the use of a base member without pegs (not shown) can be substituted for the base member 44 if the hanger assembly of the embodiment of FIGS. 1–5 is to be attached to a supporting surface without pre-existing holes. In that instance, the securing elements 58, 60 may be screws and the auxiliary screws 62, 64 or other attaching means, including even an adhesive backing on the base plate, may be used to secure the same to a supporting surface. However, since the hanger arm 40 may carry significant weight, use of the pegs 76, 78 and screw-type securing elements 58, 60 for the stop members 54, 56 and auxiliary screws 62, 64 as suggested above are preferred.

The use and operation of the hanger assembly 40 of the embodiment of FIGS. 1–5 will now be readily understood by those with ordinary skill in the art. The pegs 76, 78 are engaged in a selected pair of holes 35 in the panel member. Depending upon whether the hanger assembly 40 is to be used in association with a left- or right-hand vertically extending supporting surface, the stop members 54, 56 are attached to the assembly by engagement of threaded securing members 58, 60 in selected threaded openings 68, 70 or 72, 74 or by passing screw-type securing members through the selected openings into the panel member. The hanger arm 42 may then be rotated between the dotted line retracted position 42' shown in FIGS. 3A and 3B where it engages the stop member 54 which is carried by the base member 44 in horizontally and vertically spaced relationship rearwardly and above the axis 78 so that the major portion 42*b*' of the hanger arm 42' extends generally upwardly past the vertical and inwardly of the storage compartment in juxtaposition to the supporting surface 22*a* or 22*b* for storage. In this relationship, the hanger arm 42' will not obstruct other use of the storage compartment such as for hanging clothes and the like.

When it is desired to temporarily support one or more articles, such as hanging clothes or the like (not shown), the hanger arm 42' may be rotated about the axis 78 to the solid line operative position 42 shown in FIGS. 3A and 3B wherein it rests on the stop member 56 with the major portion 42*b* of the hanger arm 42 extending generally horizontally beyond the front edge 22*c* of the panel 22. In this manner, the major portion 42*b* of the hanger arm 42 may carry one or more articles spaced from the storage compartment to avoid interfering with the use of the storage compartment.

As seen in FIGS. 3A and 3B, the stop member 54 is located in such a position relative to the axis 78 and the vertically extending row 32 of holes 35 as to engage and support the major portion 42*b*' of the hanger arm 42' in the retracted position of the hanger arm. In this preferred embodiment, the location of the stop member 54 also engages the minor portion 42*a* of the hanger arm 42 to retain the hanger arm 42 in the generally horizontally extending operative position. Likewise, the stop member 56 supports the major portion 42*b* of the hanger arm 42 in the operative position and also engages and supports the minor portion 42*a*' of the hanger arm 42' in the retracted position. Thus, in the broadest sense, only one of the stop members is required to support the hanger arm in both the retracted and operative positions although both stop members are preferred for added stability and strength.

Reference is now made to the FIGS. 6–10 wherein a second embodiment of valet rod according to the instant inventive concepts is designated generally by the reference numeral 100 and it is shown as used in association with a standard System 32 mm modular closet organizer 20 of the same type as seen in FIGS. 1–5. The valet rod 100 includes a pair of pivot members 110, 112 and a hanger arm 140 supported by the pivot members 110, 112 for movement between an operative position shown in solid lines at 140 in FIG. 7 and a retracted position shown in dotted lines at 140' in FIG. 7.

Each of the pivot members 110, 112 is substantially identical. The pivot member 110 will be described in detail as illustrative with particular reference to FIGS. 8–10.

The pivot member 110 comprises a base member 114, a pair of bushing members 116, 118 and a securing member 120. The base member 114, as in the previous embodiment, is preferably circular and made of metal. The base member 114 includes front face 1 14a and a rear face 114*b*, the latter including a pair of diametrically opposed pegs 122, 124 for frictional engagement in selected holes 35 of the cabinet panel 24 as described above with reference to FIGS. 1–5. An enlarged boss 126 is defined in the front face 114*a* of the base member 114 with a central threaded aperture 128 defining a rotational axis 130 for the pivot member 110.

The bushing member 116 has a front face 116*a* and a rear face 116*b* and an enlarged central opening 130 adapted to be rotatably received over the boss 126 on the base member 114. The bushing member 118 has a front face 118*a* and a rear face 118b with a portion of an enlarged central opening 132 communicating with a fustoconical central opening 134 adapted to receive the frustoconical head portion 120a of the securing member 120.

Figure 7:
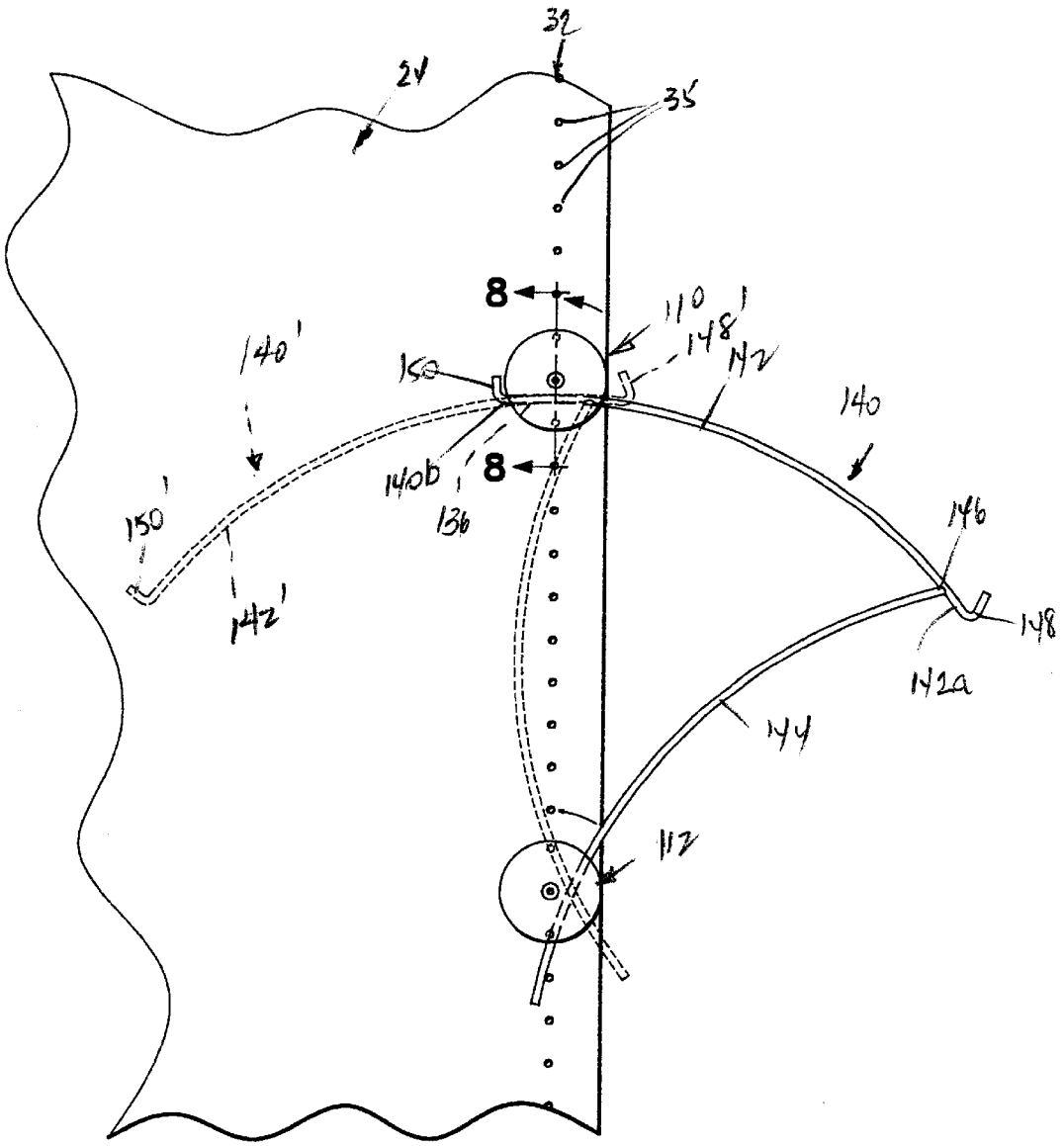
FIG. 7 is a side elevational view of the embodiment of FIG. 6 with the hanger arm in solid lines in its operative position and in dotted lines in its retracted position.

The hanger arm 140, seen best in FIG. 7, comprises a pair of arcuate arm elements 142, 144 secured to each other in any fashion at one end to form an apex 146 of the generally V-shaped hanger arm 140. A portion 142*a* of the arm element 142 extends beyond the apex 146 of the hanger arm 140 to define a stop 148 adapted to preclude one or more articles (not shown) carried by said arm element 142 in hanging relationship when the hanger arm is in its operative position from sliding off the free end of the arm element 142.

Arcuate recesses 116*c* and 118*c* are formed in the mating surfaces 116*a* and 118*b* of the bushing members 116, 118 to define an arcuate transverse through-opening 136 complementary to the cross-sectional configuration of an intermediate portion of the arm element 142 of the hanger arm 140.

Figure 8:
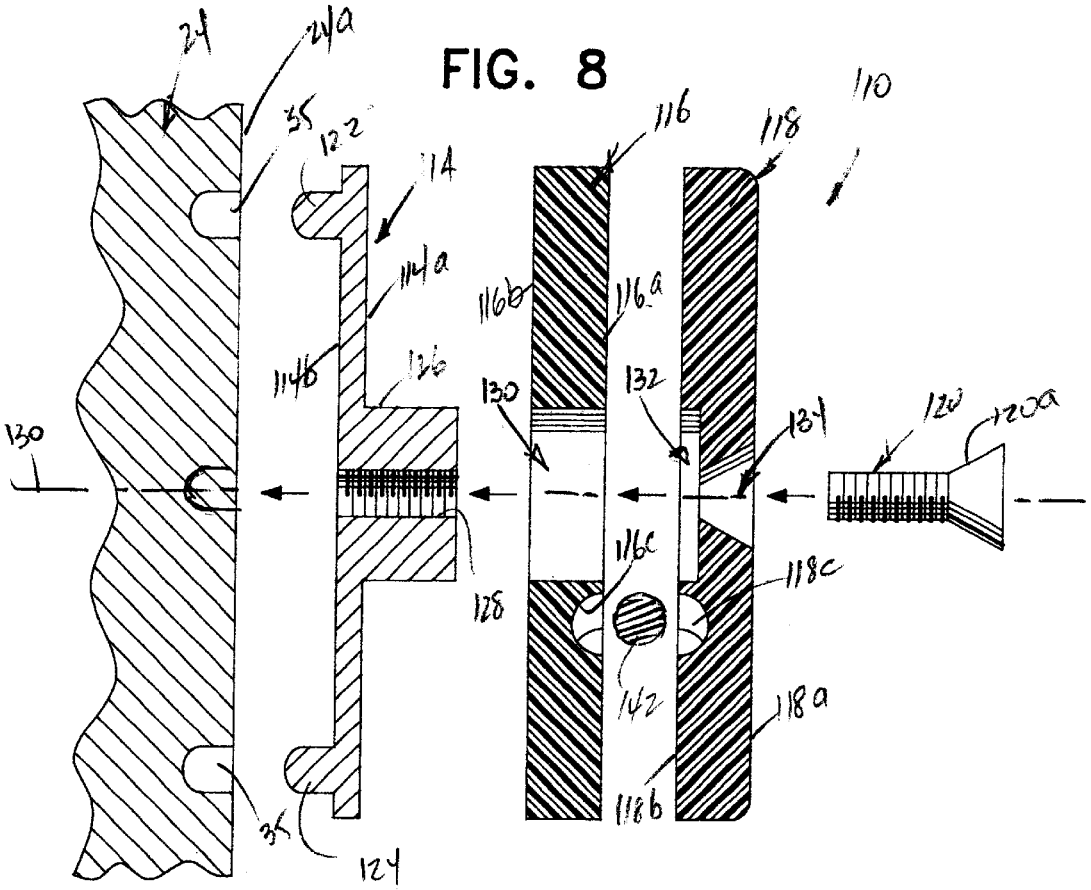
FIG. 8 is an enlarged cross-sectional view taken along lines 8—8 of FIG. 7, with the parts exploded for illustrative clarity and partially broken away for illustrative convenience.
Figure 9:
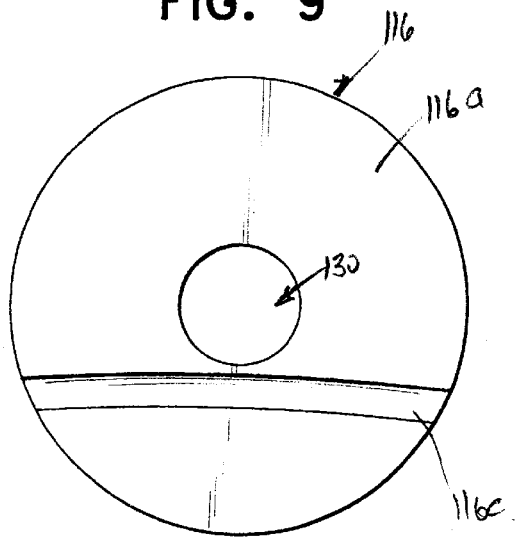
FIG. 9 is a plan view of the mating surface of one of the bushing members of the embodiment of FIG. 6.
Figure 10:
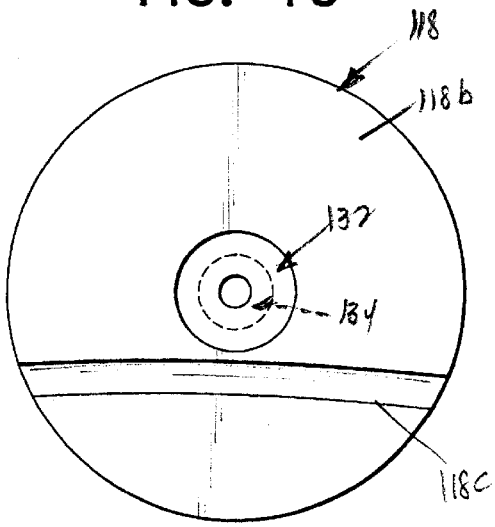
FIG. 10 is a plan view of the mating surface of the other bushing member.

When the pivot member 110 is assembled as illustrated by the arrows in FIG. 8, the arm element 142 is slidably received in the arcuate through-opening 136 formed by the recesses 116*a*, 118*b* of the bushing members 116, 118. A stop 150 is defined at its end 140*b* to limit the movement of the hanger arm 140 when it is moved to its operative position as seen in solid lines in FIG. 7. The lower end portion 144*b* of the arm element 144 is slidably received in an arcuate through-opening in the other pivot member 112 as seen in FIG. 7.

Each of the pivot members 110, 112 are rotatable about the boss on its respective base member. With the arm elements 142, 144 being slidably received in the arcuate through-openings in their respective bushing members, the V-shaped hanger arm can be moved from the storage position seen at 140' in dotted lines in FIG. 7 to the operative position seen in solid lines at 140 at FIG. 7.

The use and operation of the embodiment of FIGS. 6–10 will now be readily understood by those with ordinary skill in the art. Each of the pivot members 110, 112 are assembled with intermediate portions of respective arm elements 142, 144 of the hanger arm 140 captured in its through-opening by sliding the bushing members over the enlarged boss on the base member and engaging the securing element through the central openings into a threaded aperture in the base member or, if the securing element is an elongated screw, by passing the same through the central opening into the panel member. The peg members on the pivot members 110, 112 are engaged in selected openings 35 in the front row 32 of openings in the panel 24 in vertically spaced relationship with respect to each other to enable the hanger arm 140 to be moved between its retracted and operative positions. It will be seen that, during movement of the hanger arm 140 between these two positions, the arm elements 142, 144 slide within the through-openings in the pivot members 110, 112, and the pivot members themselves rotate about their central axes to accommodate the arcuate nature of the arm elements providing a smoothly operating and aesthetically attractive valet rod design.

Figure 11:
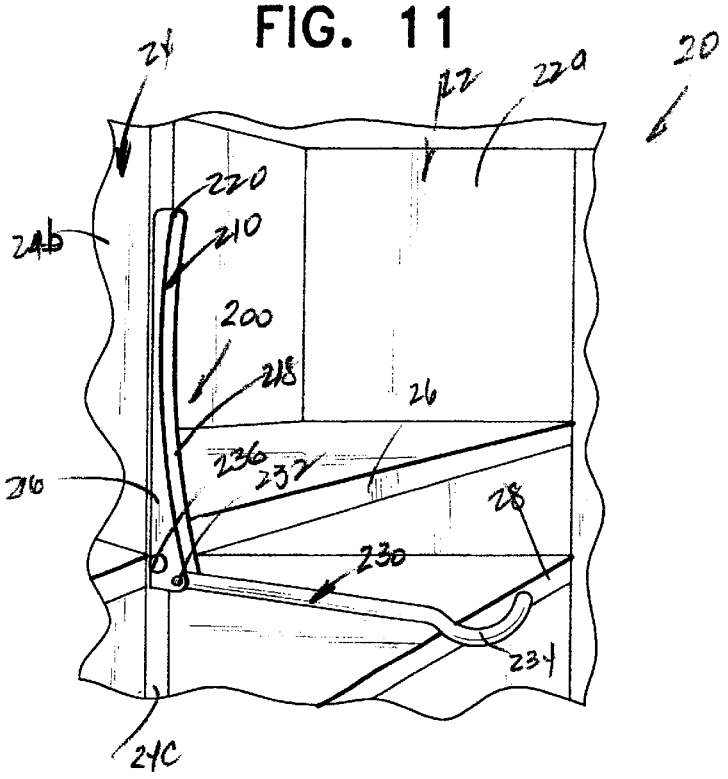
FIG. 11 is a fragmentary perspective view of a third embodiment of a valet rod according to the instant invention.
Figure 12:
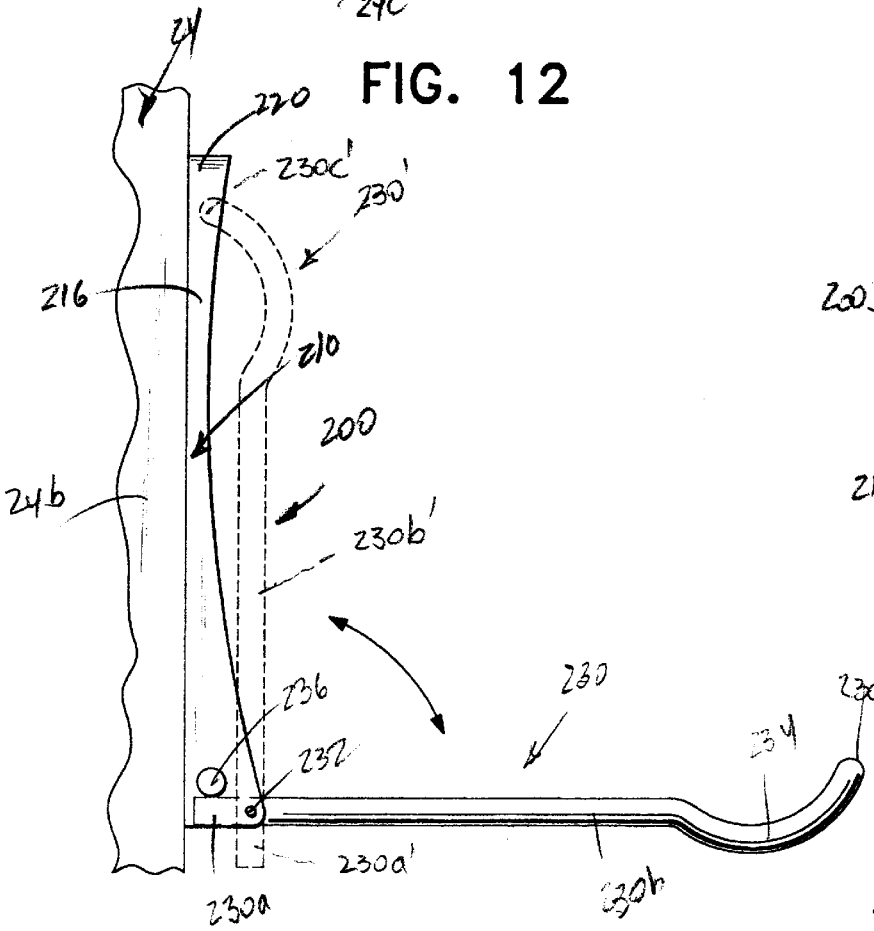
FIG. 12 is a side elevational view of the valet rod of FIG. 11 illustrating the hanger arm in its operative position in solid lines and in its retracted position in dotted lines.
Figure 13:
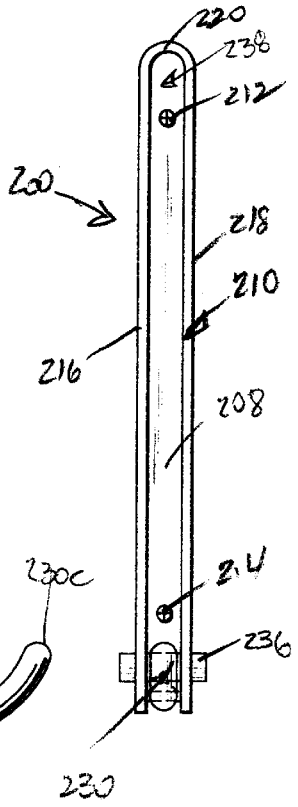
FIG. 13 is a front elevational view of the valet rod shown in FIG. 12.

With reference now to FIGS. 11–13, yet another embodiment of valet rod 20 is illustrated. In this instance, the rows of pre-formed holes 35 in the panel member are not necessary since the valet rod 200 is not designed for attachment to a side surface 24*a* or 24*b* of the panel member 24, but to a front edge surface 24*c*. Although other attaching means can obviously be used, the bottom wall 208 of a base member 210 of the valet rod 200 may include a pair of spaced through-openings for reception of screws or the like 212, 214 to secure the base member 210 to the front edge 24*c* of the panel member 24.

The base member 210 may also include an upstanding peripheral sidewall with portions 216, 218 extending from the sides of the bottom wall 208, and if desired, a connecting portion 220 at the top and/or bottom (not shown) of the portions 216, 218.

A hanger arm 230 is rotatably secured at one end by a pivot member 232 extending between side walls portions 216, 218 of the base member 210 for movement from its operative position shown in solid lines at 230 in FIG. 12 to its retracted position shown in dotted lines at 230'. A minor portion 230*a* of the hanger arm 230 extends beyond one side of the pivot member 232, with a major portion 230*b* extending beyond the other side of the pivot member 232 and terminating in an arcuate portion 234. The major portion 230*b* may receive one or more articles (not shown) in hanging relationship when the hanger arm 230 is in its generally horizontally extending operative position with the arcuate portion 234 also receiving articles and preventing articles from sliding off the free end 230c of the hanger arm 230.

A stop element 236 is fixed between the sidewall portions 216, 218 at the lower end of the base member 210 in spaced relationship to the axis defined by the pivot member 232. In this manner, the minor portion 230*a* of the hanger arm 230 engages the stop element 236 when the hanger arm 230 is rotated about the pivot element 232 to support the hanger arm 230 in its generally horizontally extending operative position.

When the hanger arm 230 is no longer needed, it can be rotated to the dotted line position 230' seen in FIG. 12 where the free end 230*c*' is received in a pocket 238 defined between the side member portions 216, 218 and the connecting portion 220 of the peripheral sidewall on the base member 210.

It will now be seen that there are herein provided improved valet rods, which satisfy all of the objects of the instant inventive concepts identified above, and others, including many advantages of great practical utility and commercial importance.

What is claimed is:

1. In a hanger assembly for attachment to a generally vertically extending supporting surface of a storage compartment, wherein the hanger assembly includes a hanger arm movable between a retracted position in which the hanger arm is juxtaposed to the supporting surface and stored generally within the storage compartment, and an operative position in which portions of the hanger arm are extended outwardly of the storage compartment beyond an edge formed by the supporting surface to carry one or more articles in hanging relationship spaced from the storage compartment, the improvement which comprises said hanger assembly including a pivot member and an elongated hanger arm rotatably supported by said pivot member for movement between its retracted and operative positions, said pivot member comprising:

a base member including a front face and a rear face, means to attach said base member to the supporting surface, and a bushing carried by said front face of said base member for rotation about an axis extending generally perpendicularly with respect to said base member and with respect to the supporting surface when said base member is attached to the supporting surface, said hanger arm extending transversely with respect to said axis and being carried by said bushing for rotation therewith about said axis between its retracted and operative positions, a major portion of said hanger arm extending from one side of said bushing, and a minor portion of said hanger arm extending from an opposite side of said bushing, at least one stop element located on said base member in horizontally and vertically spaced relationship with respect to said axis, the spacing of said stop elements from said axis being such that at least one of said portions of said hanger arm engages at least one of said stop elements when said hanger arm is rotated to its operative position to support said hanger arm with said major portion extending generally horizontally beyond the edge of the supporting surface to receive one or more articles in hanging relationship, and at least one of said portions of said hanger arm engages at least one of said stop elements when said hanger arm is rotated to its retracted position to support said hanger arm with said major portion extending generally vertically.

2. The hanger assembly of claim 1 wherein said major portion of said hanger arm extends generally upwardly past the vertical and inwardly of the storage compartment when said hanger arm is rotated to its retracted position.

3. The hanger assembly of claim 2 comprising a pair of stop elements located on said base member diametrically spaced from each other with respect to said axis, one of said stop elements being located forwardly of said axis and sufficiently below said axis to engage and support said major portion of said hanger arm when said hanger arm is in its operative position, and the other of said stop elements being located sufficiently rearwardly of said axis and sufficiently above said axis to engage and support said major portion of said hanger arm when said hanger arm is in its retracted position.

4. The hanger assembly of claim 2 comprising a pair of stop elements located on said base member diametrically spaced from each other with respect to said axis, one of said stop elements being located rearwardly of said axis and sufficiently above said axis to engage and support said minor portion of said hanger arm with said major portion of said hanger arm extending generally horizontally when said hanger arm is in its operative position, and the other of said stop elements being located forwardly of said axis and sufficiently below said axis to engage and support said minor portion of said hanger arm when said hanger arm is in its retracted position.

5. The hanger assembly of claim 3 wherein said one of said stop elements is also located forwardly of said axis and sufficiently below said axis to engage and support said minor portion of said hanger arm when said hanger arm is in its retracted position, and said other of said stop elements in located rearwardly of said axis and sufficiently above said axis to engage and support said minor portion of said hanger arm with said major portion of said hanger arm extending generally horizontally when said hanger arm is in its operative position.

6. The hanger assembly of claim 3 wherein the supporting surface is defined by a generally vertically extending panel of a storage compartment, the panel defining at least one row of generally uniformly spaced holes extending parallel to the edge of the panel and spaced inwardly of the storage compartment, and said means to attach said base member to the supporting surface includes at least one pair of pegs extending from said rear face of said base member, said pegs being diametrically positioned on opposite sides of said axis and spaced from each other a distance equal to, or a multiple of, the spacing between the holes in the panel, said pegs being dimensioned to be frictionally engaged in a selected pair of holes to properly locate the hanger assembly on the panel.

7. The hanger assembly of claim 6 wherein said panel is part of a modular closet organizer system.

8. The hanger assembly of claim 6 wherein the storage compartment includes opposing panels each defining a vertically extending supporting surface, each of the panels defining a row of said holes whereby said pegs can be selectively engaged in a pair of holes in either panel, securing means for removably positioning said stop elements on said base member at one of a first and second location when said hanger assembly is to be attached to one or another of the supporting surfaces on a panel, respectively.

9. The hanger assembly of claim 8 wherein each of said stop elements includes an upstanding stop member, and said securing means includes first and second pairs of openings defined in said base member, and a securing member associated with each of said stop members to enable said stop members to be selectively secured in one of said pairs of openings in use.

10. The hanger assembly of claim 9 wherein said openings pass through said base member, further including a pair of auxiliary screws to further attach said base member to the selected panel through the other of said pairs of openings.

11. The hanger assembly of claim 1 wherein said bushing defines a through-opening complementary to the cross-sectional configuration of an intermediate portion of said hanger arm and extending transversely through said axis, said intermediate portions of said hanger arm passing through said through-opening with said major and minor portions of said hanger arm extending on opposite sides of said bushing, aligned apertures on said axis extending through said bushing and said intermediate portions of said hanger arm, a hollow axle element received in said aligned apertures, and a securing element extending through said axle to secure said bushing to said base member for rotation about said axis.

12. The hanger assembly of claim 11 wherein said bushing comprises a pair of bushing members having mating surfaces, complementary portions of said through-opening defined in each of said mating surfaces.

13. In combination, a storage compartment including a panel defining a generally vertically extending supporting surface, and a hanger assembly including a pivot member and an elongated hanger arm rotatably supported by said pivot member for movement between a retracted position in which said hanger arm is juxtaposed to said supporting surface and stored generally within said storage compartment, and an operative position in which portions of said hanger arm are extended outwardly of said storage compartment beyond an edge formed by said supporting surface to carry one or more articles in hanging relationship spaced from said storage compartment, said pivot member comprising:

a base member including a front face and a rear face, means attaching said base member to said supporting surface, and a bushing carried by said front face of said base member for rotation about an axis extending generally perpendicularly with respect to said base member and said supporting surface, said hanger arm extending transversely with respect to said axis and being carried by said bushing for rotation therewith about said axis between its retracted and operative positions, a major portion of said hanger arm extending from one side of said bushing, and a minor portion of said hanger arm extending from an opposite side of said bushing, at least one stop element located on said base member in horizontally and vertically spaced relationship with respect to said axis, the spacing of said stop elements from said axis being such that at least one of said portions of said hanger arm engages at least one of said stop elements when said hanger arm is rotated to its operative position to support said hanger arm with said major portion extending generally horizontally beyond said edge of said supporting surface to receive one or more articles in hanging relationship, and at least one of said portions of said hanger arm engages at least one of said stop elements when said hanger arm is rotated to its retracted position to support said hanger arm with said major portion extending generally vertically.

14. The combination of claim 13 wherein said major portion of said hanger arm extends generally upwardly past the vertical and inwardly of the storage compartment when said hanger arm is rotated to its retracted position.

15. The combination of claim 14 comprising a pair of stop elements located on said base member diametrically spaced from each other with respect to said axis, one of said stop elements being located forwardly of said axis and sufficiently below said axis to engage and support said major portion of said hanger arm when said hanger arm is in its operative position, and the other of said stop elements being located sufficiently rearwardly of said axis and sufficiently above said axis to engage and support said major portion of said hanger arm when said hanger arm is in its retracted position.

16. The combination of claim 14 comprising a pair of stop elements located on said base member diametrically spaced from each other with respect to said axis, one of said stop elements being located rearwardly of said axis and sufficiently above said axis to engage and support said minor portion of said hanger arm with said major portion of said hanger arm extending generally horizontally when said hanger arm is in its operative position, and the other of said stop elements being located forwardly of said axis and sufficiently below said axis to engage and support said minor portion of said hanger arm when said hanger arm is in its retracted position.

17. The combination of claim 15 wherein said one of said stop elements is also located forwardly of said axis and sufficiently below said axis to engage and support said minor portion of said hanger arm when said hanger arm is in its retracted position, and said other of said stop elements in located rearwardly of said axis and sufficiently above said axis to engage and support said minor portion of said hanger arm with said major portion of said hanger arm extending generally horizontally when said hanger arm is in its operative position.

18. The combination of claim 15 wherein said panel defines at least one row of generally uniformly spaced holes extending parallel to said edge of said panel and spaced inwardly of said storage compartment, and said means to attach said base member to said supporting surface includes at least one pair of pegs extending from said rear face of said base member, said pegs being diametrically positioned on opposite sides of said axis and spaced from each other a distance equal to, or a multiple of, the spacing between the holes in the panel, said pegs being frictionally engaged in a selected pair of said holes to properly locate said hanger assembly on said panel.

19. The combination of claim 18 wherein said panel is part of a prefabricated closet organizer system.

20. The combination of claim 18 wherein said storage compartment includes opposing panels each defining a vertically extending supporting surface, each of said panels defining a row of said holes whereby said pegs can be selectively engaged in a pair of holes in either panel, securing means for removably securing said stop elements on said base member at one of a first and second location when said hanger assembly is to be attached to one or another of said supporting surfaces on a panel, respectively.

21. The combination of claim 20 wherein each of said stop elements includes an upstanding stop member, and said securing means includes first and second pairs of openings defined in said base member, and a securing member associated with each of said stop members to enable said stop members to be selectively secured in one of said pairs of openings in use.

22. The combination of claim 21 wherein said openings pass through said base member, further including a pair of auxiliary screws to further attach said base member to the selected panel through the other of said pairs of openings.

23. The combination of claim 13 wherein said bushing defines a through-opening complementary to the cross-sectional configuration of an intermediate portion of said hanger arm and extending transversely through said axis, said intermediate portions of said hanger arm passing through said through-opening with said major and minor portions of said hanger arm extending on opposite sides of said bushing, aligned apertures on said axis extending through said bushing members and said intermediate portions of said hanger arm on said axis, a hollow axle received in said aligned apertures, and a securing element extending through said axle and securing, said bushing, to said base member for rotation about said axis.

24. The combination of claim 23 wherein said bushing comprises a pair of bushing members having mating surfaces, complementary portions of said through-opening being defined in each of said mating surfaces.

25. In a hanger assembly for attachment to a generally vertically extending supporting surface of a storage compartment, wherein the hanger assembly includes a hanger arm movable between a retracted position in which the hanger arm is juxtaposed to the supporting surface and stored generally within the storage compartment, and an operative position in which portions of the hanger arm are extended outwardly of the storage compartment beyond an edge formed by the supporting surface to carry one or more articles in hanging relationship spaced from the storage compartment, the improvement which comprises said hanger assembly including a pair of pivot members and a hanger arm supported by said pivot members for movement between its retracted and operative positions, each of said pivot members comprising:

a base member including a front face and a rear face, means to attach said base member to the supporting surface, and a bushing carried by said front face for rotation about an axis extending generally perpendicularly with respect to said base member and with respect to the supporting surface when said base member is attached to the supporting surface, said hanger arm comprising:

a pair of arcuate arm elements secured to each other at one end to form an apex of a generally V-shaped hanger arm, each of said bushings defining an arcuate through-opening complementary to the cross-sectional and arcuate configuration of intermediate portions of a respective one of said arm elements, said through-openings extending transversely through its respective bushing and slidingly receiving said intermediate portions of said respective one of said arm elements, a stop element on the end of at least one of said arm elements spaced from said apex to limit the sliding movement of said one arm element through its respective through-opening when said hanging arm is moved to its operative position, and a securing element to secure each of said bushings to its respective base member for rotation about said axis.

26. The hanging assembly of claim 25 wherein said through-openings extend transversely through said bushings in spaced relationship to said axes.

27. The hanger assembly of claim 25 wherein, except for the terminal portions of each arm element, each of said arm elements defines a continuous arc from one end to the other, and the radius of the arc of each arm element is substantially the same.

28. The hanger assembly of claim 27 wherein said pivot elements are interchangeable.

29. The hanger assembly of claim 28 wherein each of said bushings comprises a pair of bushing members having mating surfaces, complementary portions of said through-openings being defined in each of said mating surfaces.

30. The hanger assembly of claim 25 wherein the supporting surface is defined by a generally vertically extending panel of a storage compartment, the panel defining at least one row of generally uniformly spaced holes extending parallel to the edge of the panel and spaced inwardly of the storage compartment, and said means to attach each of said base members to the supporting surface includes at least one pair of pegs extending from said rear face of said base member, said pegs being diametrically positioned on opposite sides of said axis and spaced from each other a distance equal to, or a multiple of, the spacing between the holes in the panel, said pegs being dimensioned to be frictionally engaged in a selected pair of holes, whereby said pivot elements can be attached to the panel at vertically spaced positions to properly located the hanger assembly.

31. The hanger assembly of claim 30 wherein said panel is part of a modular closet organizer system.

32. In combination, a storage compartment including a generally vertically extending supporting surface, and a hanger assembly including a hanger arm movable between a retracted position in which the hanger arm is juxtaposed to the supporting surface and stored generally within the storage compartment, and an operative position in which portions of the hanger arm are extended outwardly of the storage compartment beyond an edge formed by the supporting surface to carry one or more articles in hanging relationship spaced from the storage compartment, said hanger assembly including a pair of pivot members and a hanger arm supported by said pivot members for movement between its retracted and operative positions, each of said pivot members comprising:

a base member including a front face and a rear face, means attaching said base member to the supporting surface, and a bushing carried by said front face for rotation about an axis extending generally perpendicularly with respect to said base member and said supporting surface, said hanger arm comprising:

a pair of arcuate arm elements secured to each other at one end to form the apex of a generally V-shaped hanger arm, each of said bushings defining an arcuate through-opening complementary to the cross-sectional and arcuate configuration of intermediate portions of a respective one of said arm elements, said through-openings extending transversely through its respective bushing and slidingly receiving said intermediate portions of said respective one of said arm elements, a stop element on the end of at least one of said arm elements spaced from said apex to limit the sliding movement of said one arm element through its respective through-opening when said hanging arm is moved to its operative position, and a securing element securing each of said bushings to its respective base member for rotation about said axis.

33. The combination of claim 32 wherein said through-openings extend transversely through said bushings in spaced relationship to said axes.

34. The combination of claim 32 wherein, except for the terminal portions of said arm elements, each of said arm elements defines a continuous arc from one end to the other, and the radius of the arc of each arm element is substantially the same.

35. The combination of claim 34 wherein said pivot elements are interchangeable.

36. The combination of claim 34 wherein each of said bushings comprises a pair of bushing members having mating surfaces, complementary portions of said through-openings being defined in each of said mating surfaces.

37. The combination of claim 32 wherein said supporting surface is defined by a generally vertically extending panel of said storage compartment, the panel defining at least one row of generally uniformly spaced holes extending parallel to the edge of the panel and spaced inwardly of said storage compartment, and said means to attach each of said base members to said supporting surface includes at least one pair of pegs extending from said rear face of said base member, said pegs being diametrically positioned on opposite sides of said axis and spaced from each other a distance equal to, or a multiple of, the spacing between the holes in the panel, said pegs being dimensioned to be frictionally engaged in a selected pair of holes, whereby said pivot elements are attached to said panel at vertically spaced positions to properly located the hanger assembly.

38. The combination of claim 37 wherein said panel is part of a modular closet organizer system.

39. In a hanger assembly for attachment to a generally vertically extending supporting edge surface of a storage compartment, wherein the hanger assembly includes a hanger arm movable between a retracted position in which the hanger arm is juxtaposed to the supporting surface, and an operative position in which portions of the hanger arm are extended outwardly from the supporting surface to carry one or more articles in hanging relationship spaced from the storage compartment, the improvement which comprises said hanger assembly including a base member and an elongated hanger arm rotatably supported at one end by a pivot member carried by said base member for movement between its retracted and operative positions, said base member including an upper end, a lower end, a front face and a rear face, upstanding side walls including portions extending at least on both sides of said lower end of said base member, means to attach said base member to the supporting surface, said pivot member extending between said side wall portions at said lower end of said base member to define an axis extending generally perpendicularly with respect to said base member and with respect to the supporting surface when said base member is attached to the supporting surface, said hanger arm being rotatably carried by said pivot member adjacent one end of said hanger arm with a terminal portion of said hanger arm extending beyond one side of said pivot member and a major portion of said hanger arm extending beyond the other side of said pivot member, and a stop element extending between said side wall portions at said lower end of said base member in spaced relationship to said axis such that said terminal end of said hanger arm engages said stop element when said hanger arm is rotated about said pivot element to its operative position to support said hanger arm with said major portion extending generally horizontally from the supporting surface to receive one or more articles in hanging relationship.

40. The hanger assembly of claim 39, further including a hook on the other end of said hanger arm, said side walls further including portions extending about said upper end of said base member to define a pocket to receive and protect said hook when said hanger arm is in its retracted position.

41. In combination, a storage compartment including a panel defining a generally vertically extending front supporting edge surface, and a hanger assembly includes a hanger arm movable between a retracted position in which said hanger arm is juxtaposed to said supporting surface, and an operative position in which portions of said hanger arm are extended outwardly from said supporting surface to carry one or more articles in hanging relationship spaced from said storage compartment, the improvement which comprises said hanger assembly including a base member and an elongated hanger arm rotatably supported at one end by a pivot member carried by said base member for movement between its retracted and operative positions, said base member including an upper end, a lower end, a front face and a rear face, upstanding side walls including portions extending at least on both sides of said lower end of said base member, means attaching said base member to said supporting surface, said pivot member extending between said side wall portions at said lower end of said base member to define an axis extending generally perpendicularly with respect to said base member and with respect to said supporting surface, said hanger arm being rotatably carried by said pivot member adjacent one end of said hanger arm with a terminal portion of said hanger arm extending beyond one side of said pivot member and a major portion of said hanger arm extending beyond the other side of said pivot member, and a stop element extending between said side wall portions at said lower end of said base member in spaced relationship to said axis such that said terminal end of said hanger arm engages said stop element when said hanger arm is rotated about said pivot element to its operative position to support said hanger arm with said major portion extending generally horizontally from said supporting surface to receive one or more articles in hanging relationship.

42. The combination of claim 41 further including a hook on the other end of said hanger arm, said side walls including further portions extending about said upper end of said base member to define a pocket to receive and protect said book when said hanger arm is in its retracted position.

* * * * *